US007178514B2

(12) United States Patent
Chang

(10) Patent No.: US 7,178,514 B2
(45) Date of Patent: Feb. 20, 2007

(54) CROSSBOW WITH A VIBRATION-DAMPING DEVICE

(75) Inventor: Chu-Wei Chang, Feng-Yuan (TW)

(73) Assignee: Poe Lang Enterprise Co., Ltd., Taichung Hsien (TW)

( * ) Notice: Subject to any disclaimer, the term of this patent is extended or adjusted under 35 U.S.C. 154(b) by 37 days.

(21) Appl. No.: 11/044,011

(22) Filed: Jan. 28, 2005

(65) Prior Publication Data

US 2006/0169259 A1 Aug. 3, 2006

(51) Int. Cl.
*F41B 5/12* (2006.01)

(52) U.S. Cl. ..... 124/25; 124/89

(58) Field of Classification Search ..... 124/25, 124/89

See application file for complete search history.

(56) References Cited

U.S. PATENT DOCUMENTS 3,483,857 A * 12/1969 Jones ..... 124/25
4,716,880 A * 1/1988 Adkins ..... 124/25
5,280,779 A * 1/1994 Smith ..... 124/88
5,553,596 A * 9/1996 Bednar ..... 124/25

* cited by examiner

*Primary Examiner*—John A. Ricci
(74) *Attorney, Agent, or Firm*—Rabin & Berdo, P.C.

(57) ABSTRACT

A crossbow with a vibration-damping device has a stock assembly, a bow assembly, a bushing and at least one resilient element. The stock assembly has a front end. The bow assembly is attached to the front end of the stock assembly. The bushing is clamped between the stock assembly and the bow assembly. The at least one resilient element serves as a vibration-damping device and is clamped between the bushing and the bow assembly. By adding the resilient element, vibrations of the bow assembly are greatly reduced, and the bushing can be selectively made of rigid material to keep the structure of the crossbow sturdy.

2 Claims, 4 Drawing Sheets

CROSSBOW WITH A VIBRATION-DAMPING DEVICE

BACKGROUND OF THE INVENTION

1. Field of the Invention

The present invention relates to a crossbow, and more particularly to a crossbow that has a vibration-damping device to reduce vibration of the crossbow after shooting an arrow.

2. Description of Related Art

With reference to FIG. 4, a conventional crossbow comprises a stock assembly (50), a bow assembly (60), and a bushing (70).

The stock assembly (50) has a butt (52), a barrel (54) and a bowstring holder (56). The butt (52) has a top, a bottom, a front end and a rear end. The barrel (54) is mounted on the top of the butt (52) at the front end and has a front end, a rear end, a top, an arrow groove and a trigger (542). The trigger (542) is mounted pivotally in the rear end of the barrel (54) and protrudes from the top of the barrel (54) and the bottom of the butt (52). The bowstring holder (56) is mounted at the rear end of the barrel (54), engages and is released by the trigger (542).

The bow assembly (60) has a mating block (64), a bow (62), and a bowstring (66). The mating block (64) has two sides, a rear face and a bushing recess (642). The bushing recess (642) is defined in the rear face. The bow (62) is composed of two resilient arms and two optional pulley wheels (622). Each resilient arm has a proximal end and a distal end. The proximal ends of the arms are attached respectively to and extend out from the sides of the mating block (64). The pulley wheels (622) may be rotatably attached respectively to the distal ends of the resilient arms. The bowstring (66) is connected between the distal ends of the resilient arms of the bow (62), selectively engages the bowstring holder (56) when the bowstring (66) is pulled back and may be threaded around the pulley wheels (622) to increase the strength of the crossbow.

The bushing (70) is mounted inside the bushing recess (642) between the mating block (64) and the barrel (54) of the stock assembly (50) and is usually made of resilient plastic. The resilient plastic bushing (70) provides some shock-absorbing capability to the crossbow. However, the bushing (70) is unlikely to provide enough rigidity to firmly connect the bow assembly (60) to the stock assembly (50). When the bushing (70) has adequate rigidity to attach the bow assembly (60) to the stock assembly (50), the bushing (70) has a very poor vibration-damping capability.

To overcome the shortcomings, the present invention provides a crossbow with an improved vibration-damping device to mitigate or obviate the aforementioned problems.

SUMMARY OF THE INVENTION

The main objective of the invention is to provide a crossbow with a vibration-damping device, a strong structure and an excellent vibration-damping capability.

To achieve the foregoing main objective, the crossbow with a vibration-damping device comprises a stock assembly, a bow assembly, a bushing and at least one resilient element. The stock assembly has a front end. The bow assembly is attached to the front end of the stock assembly. The bushing is clamped between the stock assembly and the bow assembly. The at least one resilient element serves as a vibration-damping device and is clamped between the bushing and the bow assembly.

By adding the resilient element, vibrations of the bow assembly are sufficiently reduced, and the bushing can be selectively made of rigid material to keep the structure of the crossbow sturdy.

Other objects, advantages and novel features of the invention will become more apparent from the following detailed description when taken in conjunction with the accompanying drawings.

DETAILED DESCRIPTION OF PREFERRED EMBODIMENT

A crossbow with a vibration-damping device in accordance with the present invention comprises a stock assembly, a bow assembly, a bushing and at least one resilient element. The stock assembly has a front end. The bow assembly is attached to the front end of the stock assembly. The bushing is clamped between the stock assembly and the bow assembly. The at least one resilient element serves as a vibration-damping device and is clamped between the bushing and the bow assembly. By adding the resilient element, vibrations of the bow assembly are greatly reduced, and the bushing can be selectively made of rigid material to keep the structure of the crossbow sturdy.

Figure 1:
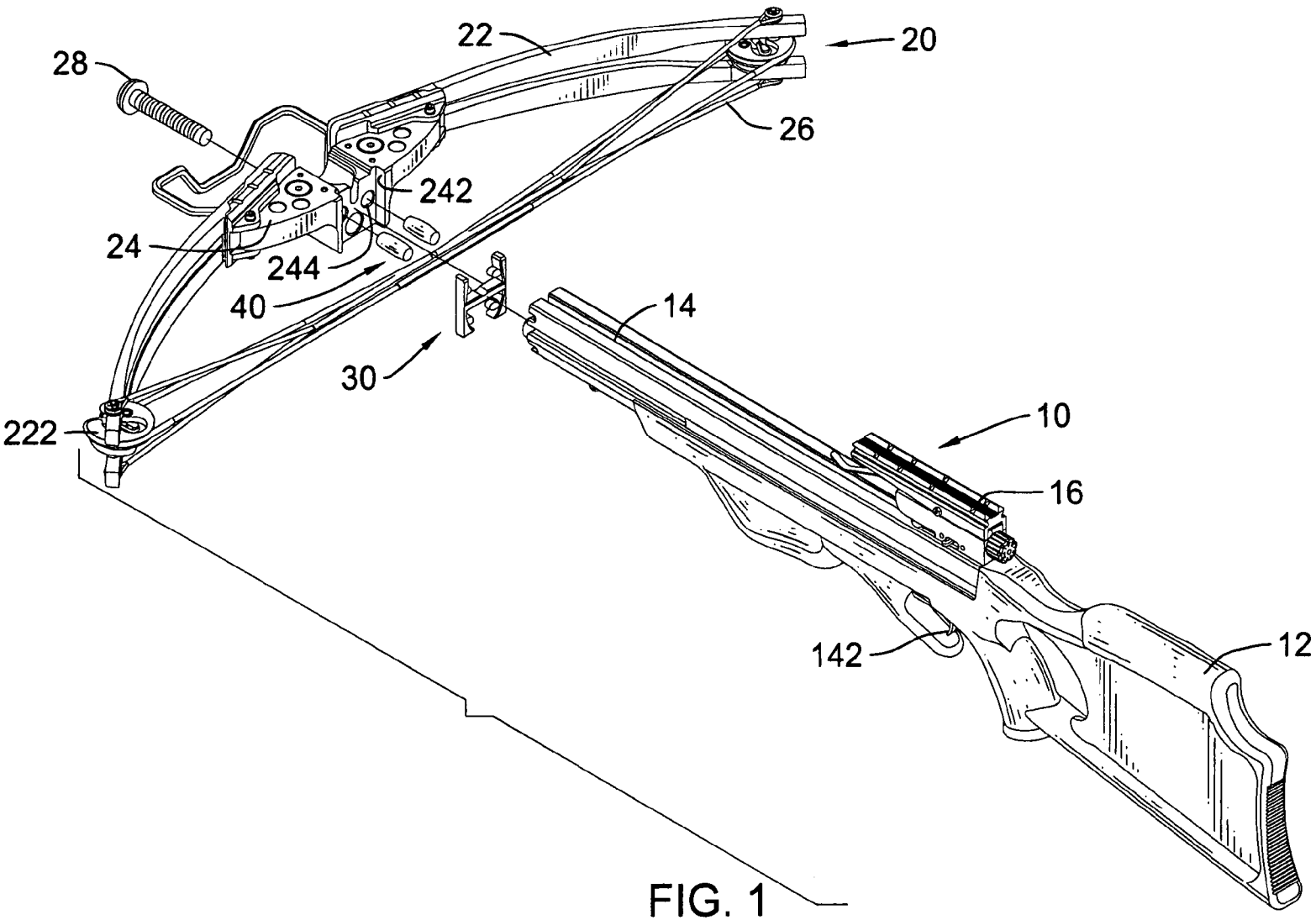
FIG. 1 is an exploded perspective view of a crossbow with a vibration-damping device in accordance with the present invention.
Figure 2:
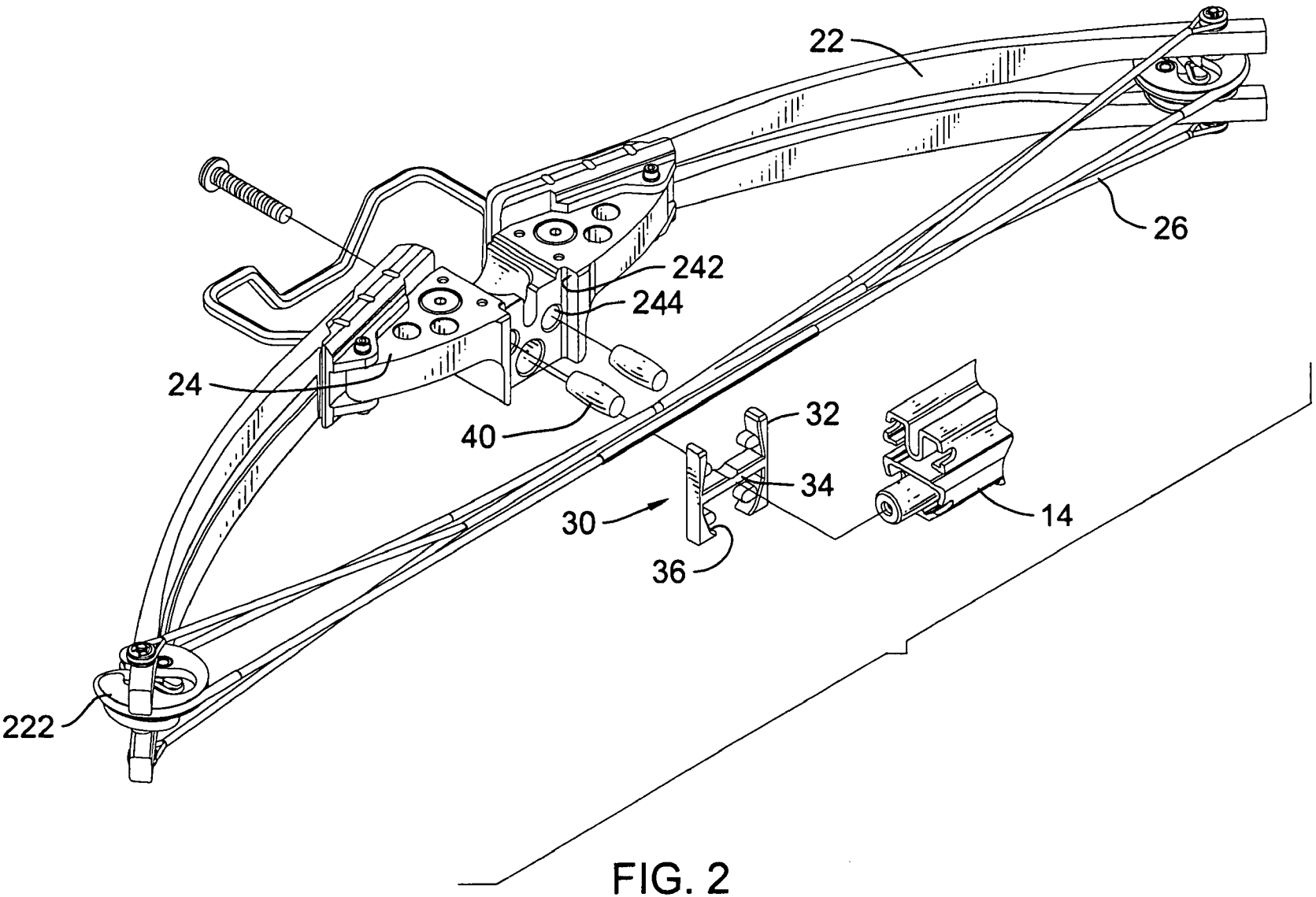
FIG. 2 is an enlarged perspective view of a bow assembly and the vibration-damping device in FIG. 1.
Figure 3:
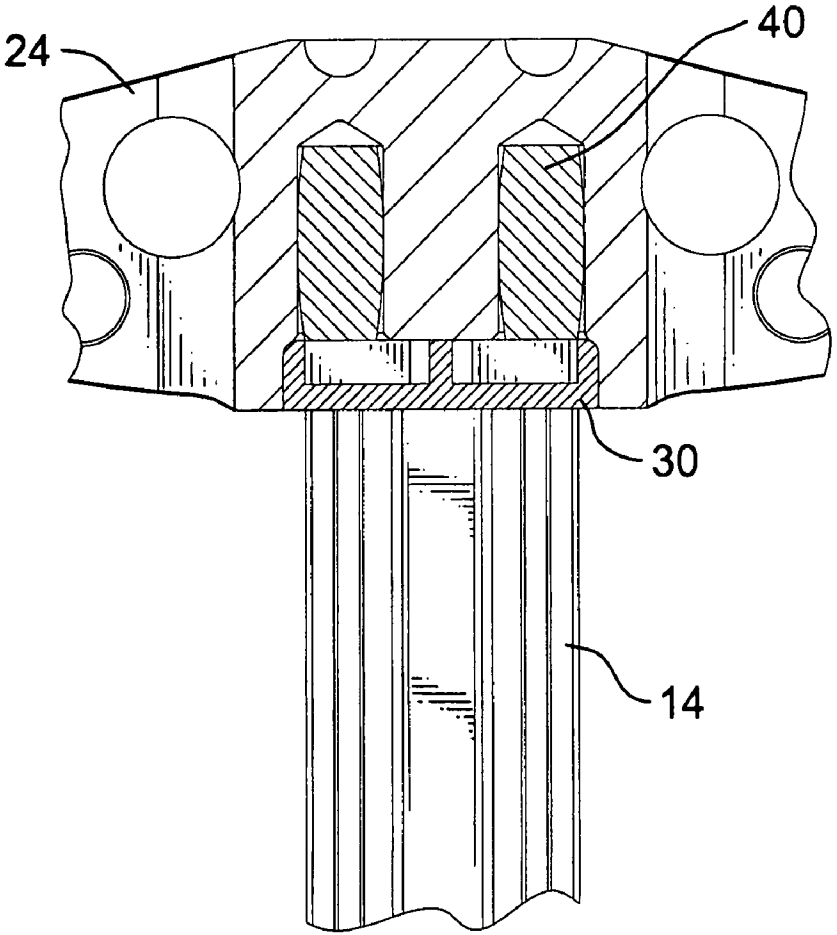
FIG. 3 is a top view in partial section of the vibration-damping device in FIG. 1 mounted in the crossbow.
Figure 4:
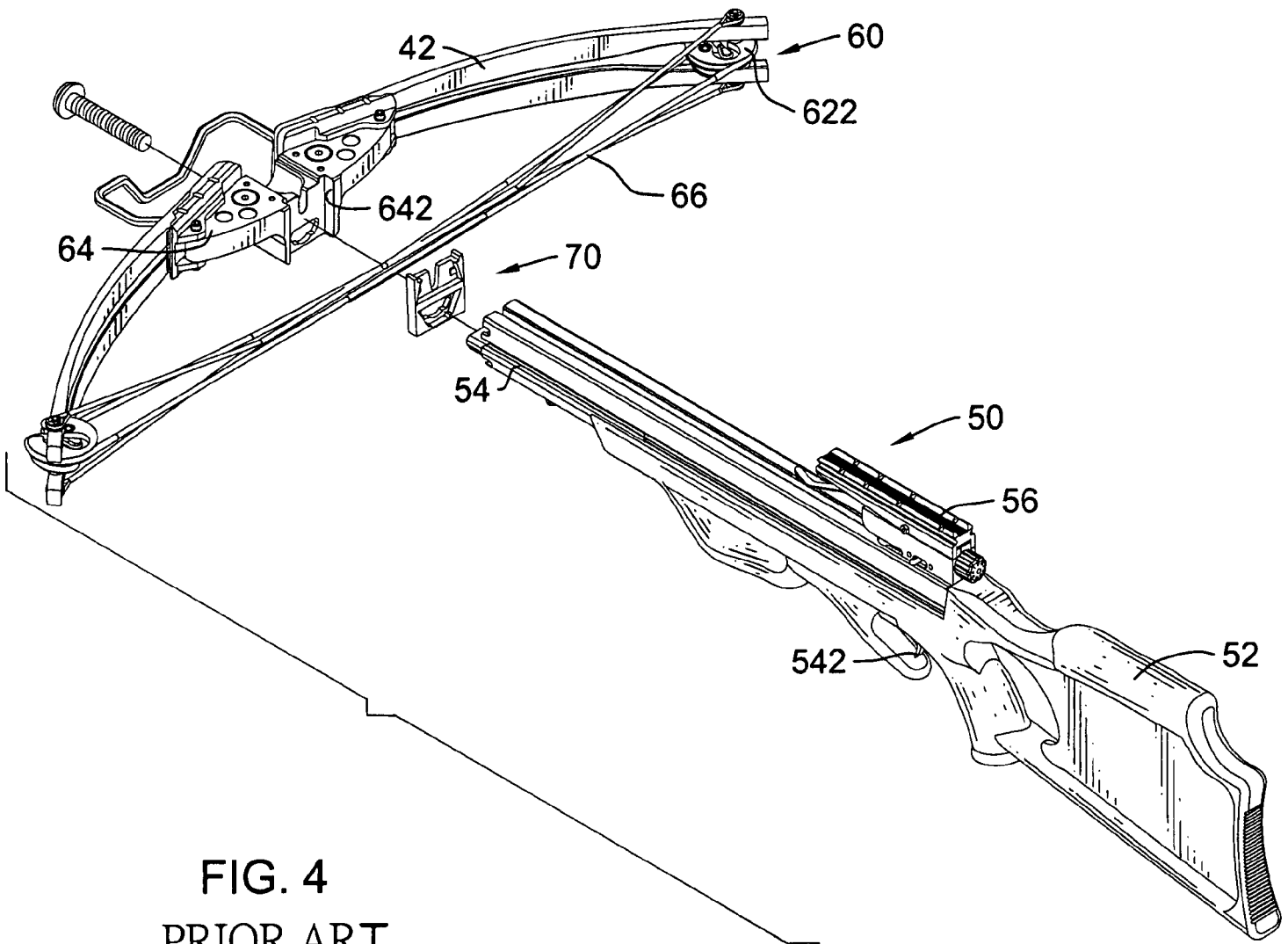
FIG. 4 PRIOR ART
FIG. 4 is an exploded perspective view of a conventional crossbow in accordance with the prior art.

With reference to FIGS. 1 to 3, a preferred embodiment of the crossbow in accordance with the present invention comprises a stock assembly (10), a bow assembly (20), a bushing (30) and two resilient elements (40).

The stock assembly (10) has a butt (12), a barrel (14) and a bowstring holder (16). The butt (12) has a top, a bottom, a front end and a rear end. The barrel (14) is mounted on the top of the butt (12) at the front end and has a front end, a rear end, a top, an arrow groove and a trigger (142). The trigger (142) is mounted pivotally in the rear end of the barrel (14) and protrudes from the top of the barrel (14) and the bottom of the butt (12). The bowstring holder (16) is mounted at the rear end of the barrel (14), engages and is released by the trigger (142).

The bow assembly (20) has a mating block (24), a bow (22) and a bowstring (26). The mating block (24) has two sides, a rear face, a bushing recess (242) and two cavities (244). The bushing recess (242) is defined in the rear face. The two cavities (244) are defined in the rear face within the bushing recess (242), and each cavity (244) has an inside end. The bow (22) is composed of two resilient arms and two optional pulley wheels (222). Each resilient arm has a proximal end and a distal end. The proximal ends of the arms are attached respectively to and extend out from the sides of the mating block (24). The pulley wheels (222) may be rotatably attached respectively to the distal ends of the resilient arms. The bowstring (26) is connected between the distal ends of the resilient arms of the bow (22), selectively engages the bowstring holder (16) when the bowstring (26) is pulled back and may be threaded around the pulley wheels (222) to increase the strength of the crossbow.

The bushing (30) is H-shaped, is mounted inside the bushing recess (242) between the mating block (24) and the barrel (14) of the stock assembly (10), is composed of two sidewalls (32), a crossbar (34) and two passages (36) and has an outer edge and an inner edge. The outer edge corresponds to the bushing recess (242), and the inner edge corresponds to the front end of the barrel (14). Therefore, the bushing (30) respectively matches the bow assembly (20) and stock assembly (10) and serves as a stabilizer between these assemblies. Moreover, a thread rod (28) screws the bow assembly (20), the bushing (30) and the stock assembly (10) together to keep the crossbow sturdy.

The two resilient elements (40) are cylindrical and are mounted respectively in the two cavities (244) in the rear face of the mating block (24). Each resilient element (40) has two ends respectively abutting the inside end of the corresponding cavity (244) in the mating block (24) and the crossbar (34) of the bushing (30) to attenuate vibrations in the bow assembly (20).

By adding the two resilient elements (40) between the mating block (24) and the bushing (30), vibrations are greatly reduced. Moreover, the bushing (30) can be made of rigid material to firmly attach the bow assembly (20) to the stock assembly (10) and significantly increase the strength and stability of the entire crossbow.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A crossbow with a vibration-damping device, the crossbow comprising:

a stock assembly having a front end;

a bow assembly attached to the front end of the stock assembly and having a mating block having two sides;

a rear face;

a bushing recess defined in the rear face; and two cavities defined in the rear face within the bushing recess;

a bow composed of two resilient arms, each resilient arm having a proximal end attached to and extending out from one of the two sides of the mating block; and a distal end;

a bowstring connected between the two distal ends of the resilient arm; and a bushing clamped between the stock assembly and the bow assembly; and at least one resilient element serving as a vibration-damping device and mounted inside the cavities inside the mating block between the bushing and the bow assembly.

2. The crossbow as claimed in claim 1, wherein the bushing is mounted inside the bushing recess and is H-shaped.

* * * * *